US011820161B2

(12) United States Patent
Mochizuki

(10) Patent No.: US 11,820,161 B2
(45) Date of Patent: Nov. 21, 2023

(54) THREE-DIMENSIONAL OBJECT PRINTING APPARATUS AND THREE-DIMENSIONAL OBJECT PRINTING METHOD

(71) Applicant: SEIKO EPSON CORPORATION, Tokyo (JP)

(72) Inventor: Kenju Mochizuki, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/450,079

(22) Filed: Oct. 6, 2021

(65) Prior Publication Data

US 2022/0111660 A1 Apr. 14, 2022

(30) Foreign Application Priority Data

Oct. 9, 2020 (JP) ..... 2020-171064

(51) Int. Cl.
*B41J 3/407* (2006.01)

(52) U.S. Cl.
CPC ..... *B41J 3/4073* (2013.01)

(58) Field of Classification Search
None
See application file for complete search history.

(56) References Cited

U.S. PATENT DOCUMENTS

2016/0176115 A1* 6/2016 Becker ..... B25J 9/1679 425/150
2017/0232616 A1* 8/2017 Shino ..... B25J 13/088 700/253

FOREIGN PATENT DOCUMENTS

JP 2015-196123 A 11/2015
JP 2017-019059 A 1/2017

* cited by examiner

*Primary Examiner* — Erica S Lin
(74) *Attorney, Agent, or Firm* — WORKMAN NYDEGGER

(57) ABSTRACT

A three-dimensional object printing apparatus includes: a liquid discharging head that discharges liquid to a three-dimensional workpiece; a robot that has N movable portions and that changes a relative position of the liquid discharging head with respect to the workpiece, where N is a natural number greater than or equal to 2; and N encoders provided for the N movable portions to measure amounts of operations of the N movable portions, respectively. Correspondence information regarding a correspondence relationship between an output from a first encoder and a time during operation of the robot is stored. The first encoder is one of the N encoders. Discharging operation of the liquid discharging head is controlled based on an output from the first encoder and the correspondence information, while the robot is operated.

6 Claims, 12 Drawing Sheets

THREE-DIMENSIONAL OBJECT PRINTING APPARATUS AND THREE-DIMENSIONAL OBJECT PRINTING METHOD

The present application is based on, and claims priority from JP Application Serial Number 2020-171064, filed Oct. 9, 2020, the disclosure of which is hereby incorporated by reference herein in its entirety.

BACKGROUND

1. Technical Field

The present disclosure relates to a three-dimensional object printing apparatus and a three-dimensional object printing method.

2. Related Art

Three-dimensional object printing apparatuses have been known that perform printing on surfaces of three-dimensional objects by an inkjet printing system. For example, JP-A-2015-196123 discloses an apparatus that applies coating fluid to a concaved substrate by an inkjet printing system. The apparatus disclosed in JP-A-2015-196123 includes a moving device that transports the substrate in one direction and a raising/lowering device that raises/lowers an application head based on the inkjet printing system. The application head discharges droplets at a time interval based on an output of a linear encoder provided for the moving mechanism.

Examples of a mechanism for changing the relative position between a three-dimensional object that is a print target and an inkjet head include a multi-axis robot, in addition to a configuration using a moving mechanism and a raising/lowering mechanism that operate along one axis, as in JP-A-2015-196123. In multi-axis robots, the position of a tool center point (TCP) can generally be determined as coordinate values of a base coordinate system for each robot through computation based on all outputs from encoders provided for joints. Accordingly, when a multi-axis robot is used, it is conceivable that the timing of discharge from the inkjet head is specified based on the coordinate values. When the discharge timing is specified in such a manner, however, there is a problem that a print position is displaced or a print timing is shifted owing to the time taken for determining the coordinate values.

SUMMARY

In order to overcome the above-described problem, according to an aspect of the present disclosure, there is provided a three-dimensional object printing apparatus including: a liquid discharging head that discharges liquid to a three-dimensional workpiece; a robot that has N movable portions and that changes a relative position of the liquid discharging head with respect to the workpiece, where N is a natural number greater than or equal to 2; and N encoders provided for the N movable portions to measure amounts of operations of the N movable portions, respectively. Correspondence information regarding a correspondence relationship between an output from a first encoder and a time during operation of the robot is stored. The first encoder is one of the N encoders. Discharging operation of the liquid discharging head is controlled based on an output from the first encoder and the correspondence information, while the robot is operated.

According to another aspect of the present disclosure, there is provided a three-dimensional object printing apparatus including: a liquid discharging head that discharges liquid to a three-dimensional workpiece; a robot that has N movable portions and that changes a relative position of the liquid discharging head with respect to the workpiece, where N is a natural number greater than or equal to 2; and N encoders provided for the N movable portions to measure amounts of operations of the N movable portions, respectively. Correspondence information regarding a correspondence relationship between an output from the first encoder and the relative position during operation of the robot is stored. The first encoder is one of the N encoders. The discharging operation of the liquid discharging head is controlled based on an output from the first encoder and the correspondence information, while the robot is operated.

According to another aspect of the present disclosure, there is provided a three-dimensional object printing apparatus including: a liquid discharging head that discharges liquid to a three-dimensional workpiece; a robot that has N movable portions and that changes a relative position of the liquid discharging head with respect to the workpiece, where N is a natural number greater than or equal to 2; N encoders provided for the N movable portions to measure amounts of operations of the N movable portions, respectively; a control module that controls discharging operation of the liquid discharging head; first processing circuitry; and second processing circuitry. The first processing circuitry computes the amounts of operations of the respective N movable portions, based on path information indicating a path along which the liquid discharging head is to move. A first encoder that is one of the N encoders is electrically coupled to the first processing circuitry via the second processing circuitry. The control module is electrically coupled to the second processing circuitry.

According to yet another aspect of the present disclosure, there is provided a three-dimensional object printing method that performs printing on a three-dimensional workpiece by using: a liquid discharging head that discharges liquid to the workpiece; a robot that has N movable portions and that changes a relative position of the liquid discharging head with respect to the workpiece, where N is a natural number greater than or equal to 2; and N encoders provided for the N movable portions to measure amounts of operations of the N movable portions, respectively. The method includes: storing correspondence information regarding a correspondence relationship between an output from a first encoder and a time during operation of the robot, the first encoder being one of the N encoders; and controlling discharging operation of the liquid discharging head, based on an output from the first encoder and the correspondence information, while operating the robot.

According to a further aspect of the present disclosure, there is provided a three-dimensional object printing method that performs printing on a three-dimensional workpiece by using: a liquid discharging head that discharges liquid to the workpiece; a robot that has N movable portions and that changes a relative position of the liquid discharging head with respect to the workpiece, where N is a natural number greater than or equal to 2; and N encoders provided for the N movable portions to measure amounts of operations of the N movable portions, respectively. The method includes: storing correspondence information regarding a correspondence relationship between an output from a first encoder and the relative position during operation of the robot, the first encoder being one of the N encoders; and controlling discharging operation of the liquid discharging head, based on an output from the first encoder and the correspondence information, while operating the robot.

DESCRIPTION OF EXEMPLARY EMBODIMENTS

Figure 1:
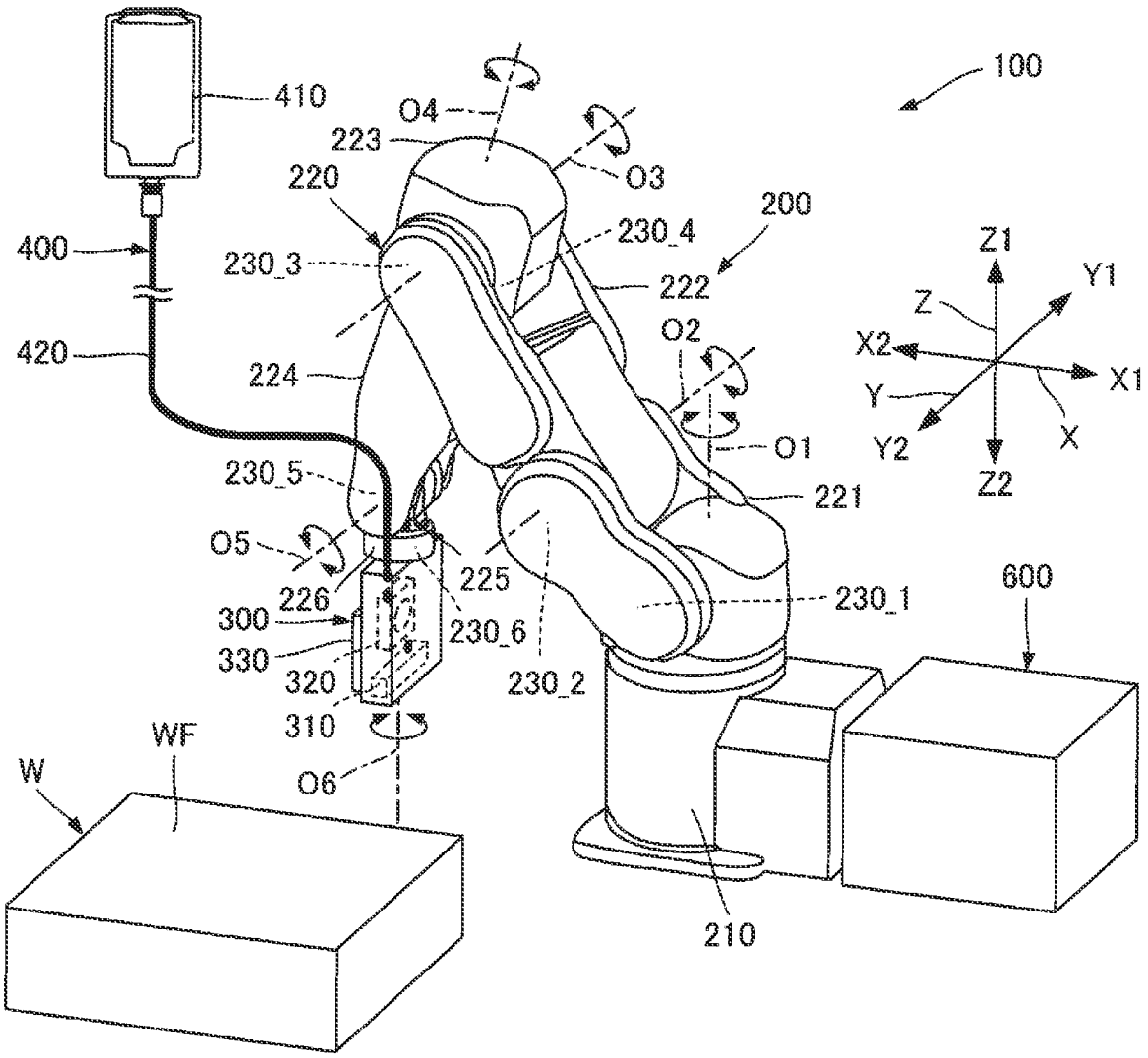
FIG. 1 is a perspective view illustrating an overview of a three-dimensional object printing apparatus according to a first embodiment.

Preferred embodiments according to the present disclosure will be described below with reference to the accompanying drawings. In the drawings, dimensions or scales of portions in the drawings differ from actual dimensions or scales, as appropriate, and some portions may be schematically illustrated for ease of understanding. The scope of the present disclosure is not limited to the embodiments, unless otherwise so stated in the following description.

The following description will be given using an X-axis, a Y-axis, and a Z-axis that cross one another, as appropriate. One direction along the X-axis is referred to as an "X1 direction", and the direction opposite to the X1 direction is referred to as an "X2 direction". Similarly, directions that are opposite to each other along the Y-axis are referred to as a "Y1 direction" and a "Y2 direction". Also, directions that are opposite to each other along the Z-axis are referred to as a "Z1 direction" and a "Z2 direction".

Herein, the X-axis, the Y-axis, and the Z-axis are coordinate axes of a base coordinate system set in a space where a three-dimensional workpiece W described below and a base 210 are placed. Typically, the Z-axis is a vertical axis, and the Z2 direction corresponds to a downward direction in the vertical direction. The Z-axis does not necessarily have to be a vertical axis. Also, although the X-axis, the Y-axis, and the Z-axis typically cross one another orthogonally, they do not necessarily have to cross one another orthogonally. For example, the X-axis, the Y-axis, and the Z-axis may cross one another at an angle in the range of 80° or more and 100° or less.

1. First Embodiment

1-1. Overview of Three-Dimensional Object Printing Apparatus

FIG. 1 is a perspective view illustrating an overview of a three-dimensional object printing apparatus 100 according to a first embodiment. The three-dimensional object printing apparatus 100 performs printing on a surface of a three-dimensional workpiece W by using an inkjet printing system.

The workpiece W has a surface WF that is a print target. In the example illustrated in FIG. 1, the workpiece W is a cuboid, and the surface WF is a plane that faces in the Z1 direction. The print target may be a surface, other than the surface WF, of a plurality of surfaces of the workpiece W. The size, the shape, or the placement orientation of the workpiece W is not limited to the example illustrated in FIG. 1 and is arbitrary.

In the example illustrated in FIG. 1, the three-dimensional object printing apparatus 100 is an inkjet printer using a vertical articulated robot. Specifically, as illustrated in FIG. 1, the three-dimensional object printing apparatus 100 includes a robot 200, a liquid discharging unit 300, a liquid supply unit 400, and a controller 600. First, individual portions in the three-dimensional object printing apparatus 100 illustrated in FIG. 1 will be described below.

The robot 200 is a moving mechanism for changing the position and the orientation of the liquid discharging unit 300 with respect to the workpiece W. In the example illustrated in FIG. 1, the robot 200 is a so-called six-axis vertical articulated robot. Specifically, the robot 200 includes the base 210 and an arm 220.

The base 210 is a stand that supports the arm 220. In the example illustrated in FIG. 1, the base 210 is secured to an installation surface, such as a floor surface facing in the Z1, by screwing or the like. The installation surface to which the base 210 is secured may be a surface facing in any direction and is not limited to the example illustrated in FIG. 1. Examples of the installation surface include a wall, a ceiling, and a surface of a movable carriage, wheeled platform, or the like.

The arm 220 is a six-axis robot arm having a base end, which is attached to the base 210, and a leading end, which three-dimensionally changes its position and orientation with respect to the base end. Specifically, the arm 220 has arms 221, 222, 223, 224, 225, and 226, which are coupled in that order.

The arm 221 is coupled to the base 210 via a joint portion 230_1 to be rotatable about a first rotation axis O1. The arm 222 is coupled to the arm 221 via a joint portion 230_2 to be rotatable about a second rotation axis O2. The arm 223 is coupled to the arm 222 via a joint portion 230_3 to be rotatable about a third rotation axis O3. The arm 224 is coupled to the arm 223 via a joint portion 230_4 to be rotatable about a fourth rotation axis O4. The arm 225 is coupled to the arm 224 via a joint portion 230_5 to be rotatable about a fifth rotation axis O5. The arm 226 is coupled to the arm 225 via a joint portion 230_6 to be rotatable about a sixth rotation axis O6. Each of the joint portions 230_1 to 230_6 may hereinafter be referred to as a "joint portion 230".

Each of the joint portions 230_1 to 230_6 is one example of a "movable portion". FIG. 1 illustrates a case in which the number of movable portions, N, is 6. In the example illustrated in FIG. 1, each of the joint portions 230_1 to 230_6 is a mechanism that rotatably couples one of two adjacent arms to the other. Although not illustrated in FIG. 1, each of the joint portions 230_1 to 230_6 is provided with a drive mechanism for rotating one of two adjacent arms with respect to the other. Each drive mechanism includes, for example, a motor for generating driving force for the rotation, a decelerator for decelerating the driving force and outputting the resulting driving force, and an encoder, such as a rotary encoder, for detecting the amount of operation, such as an angle of the rotation. The assembly of the drive mechanisms corresponds to an arm drive mechanism 240 described below and illustrated in FIG. 2. The encoders correspond to encoders 241 described below and illustrated in FIG. 2 and so on.

The first rotation axis O1 is an axis that is orthogonal to the installation surface (not illustrated) to which the base 210 is secured. The second rotation axis O2 is an axis that is orthogonal to the first rotation axis O1. The third rotation axis O3 is an axis that is parallel to the second rotation axis O2. The fourth rotation axis O4 is an axis that is orthogonal to the third rotation axis O3. The fifth rotation axis O5 is an axis that is orthogonal to the fourth rotation axis O4. The sixth rotation axis O6 is an axis that is orthogonal to the fifth rotation axis O5.

With respect to the rotation axes O1 to O6, the term "orthogonal" includes not only a case in which the angle made by two rotation axes is exactly 90° but also a case in which the angle made by two rotation axes is shifted in the range of about ±5° relative to 90°. Similarly, the term "parallel" includes not only a case in which two rotation axes are exactly parallel to each other but also a case in which one of two rotation axes is inclined relative to the other in the range of about ±5°.

The liquid discharging unit 300 is attached to the leading end, that is, the arm 226, of the arm 220 as an end effector.

The liquid discharging unit 300 is a mechanism having a liquid discharging head 310 that discharges ink, which is one example of liquid, to the workpiece W. In the present embodiment, the liquid discharging unit 300 includes a pressure regulating valve 320 and a sensor 330 in addition to the liquid discharging head 310. The pressure regulating valve 320 regulates pressure of ink to be supplied to the liquid discharging head 310, and the sensor 330 detects a relative positional relationship of the liquid discharging head 310 with respect to the workpiece W. Since the liquid discharging head 310, the pressure regulating valve 320, and the sensor 330 are all secured to the arm 226, the relationship of the positions and the orientations thereof is fixed.

Although not illustrated in FIG. 1, the liquid discharging head 310 includes a plurality of piezoelectric elements, a plurality of cavities for accommodating ink, and a plurality of nozzles. The nozzles are provided for the cavities, respectively, and communicate with the cavities. The piezoelectric elements are provided for the cavities, respectively. By varying pressures in the cavities, the piezoelectric elements cause the ink to be discharged from the nozzles corresponding to the cavities. The liquid discharging head 310 is obtained, for example, by bonding a plurality of substrates, such as appropriately processed silicon substrates by etching or the like, with an adhesive or the like. The piezoelectric elements correspond to piezoelectric elements 311 described below and illustrated in FIG. 2. Heaters that heat the ink in the cavities may be used instead of the piezoelectric elements as drive elements for causing the ink to be discharged from the nozzles.

The pressure regulating valve 320 is a valve mechanism that opens/closes according to the pressure of the ink in the liquid discharging head 310. Owing to the opening/closing, the pressure of the ink in the liquid discharging head 310 is maintained at a negative pressure in a predetermined range. This stabilizes ink meniscuses formed at the nozzles N in the liquid discharging head 310. This prevents air bubbles from entering the nozzles N and prevents the ink from spilling out from the nozzle N.

Although each of the number of liquid discharging heads 310 and the number of pressure regulating valves 320 included in the liquid discharging unit 300 is one in the example illustrated in FIG. 1, the numbers are not limited to the example illustrated in FIG. 1 and may be two or more. The installation positions of the pressure regulating valve 320 and the sensor 330 are not limited to the arm 226 and may be, for example, another arm or the like or a position that is fixed with respect to the base 210.

The sensor 330 detects the relative positional relationship of the liquid discharging head 310 with respect to the workpiece W in a predetermined direction. Specifically, the sensor 330 is a distance sensor, such as an optical displacement meter, for measuring a distance to a reference surface (not illustrated) whose relative position is fixed with respect to the workpiece W. The reference surface may be a surface of the workpiece W or may be a surface of an object different from the workpiece W. A direction in which the reference surface faces may be any direction as long as the position and orientation with respect to the surface WF of the workpiece W are recognized in advance.

The liquid supply unit 400 is a mechanism for supplying ink to the liquid discharging head 310. The liquid supply unit 400 includes a liquid reservoir 410 and a supply flow passage 420.

The liquid reservoir 410 is a container for holding ink. The liquid reservoir 410 is, for example, a bag-shaped ink container formed of a flexible film. The ink held in the liquid reservoir 410 is, for example, ink containing a coloring material, such as a dye or pigment. The type of ink held in the liquid reservoir 410 is not limited to ink containing a coloring material and may be, for example, ink containing an electrically conductive material, such as metal powder. The ink may also have curability, such as ultraviolet curability. When the ink has curability, such as ultraviolet curability, for example, the liquid discharging unit 300 is equipped with an ultraviolet irradiation mechanism.

In the example illustrated in FIG. 1, the liquid reservoir 410 is secured to a wall, a ceiling, a pole, or the like so as to be always located at a farther side in the Z1 direction than the liquid discharging head 310. That is, the liquid reservoir 410 is located above a moving area of the liquid discharging head 310 in the vertical direction. Thus, the ink can be supplied from the liquid reservoir 410 to the liquid discharging head 310 with a predetermined pressure, without use of a mechanism, such as a pump.

The liquid reservoir 410 may be located at any position, as long as the ink can be supplied from the liquid reservoir 410 to the liquid discharging head 310 with a predetermined pressure, and may be located below the liquid discharging head 310 in the vertical direction. In such a case, for example, a pump may be used to supply the ink from the liquid reservoir 410 to the liquid discharging head 310 with a predetermined pressure.

The supply flow passage 420 is a flow passage through which the ink is supplied from the liquid reservoir 410 to the liquid discharging head 310. The pressure regulating valve 320 is provided in the middle of the supply flow passage 420. Thus, even when the positional relationship between the liquid discharging head 310 and the liquid reservoir 410 changes, it is possible to reduce variations in the pressure of the ink in the liquid discharging head 310.

The supply flow passage 420 is defined by, for example, the internal space of a tube. For example, the tube used for the supply flow passage 420 has flexibility and is made of elastic material, such as rubber material or elastomer material. Since the supply flow passage 420 is made using a tube having flexibility, as described above, the relative positional relationship between the liquid reservoir 410 and the pressure regulating valve 320 is permitted to change. Accordingly, even when the position or the orientation of the liquid discharging head 310 changes while the position and the orientation of the liquid reservoir 410 are fixed, the ink can be supplied from the liquid reservoir 410 to the pressure regulating valve 320.

The supply flow passage 420 may be partly made of a member that does not have flexibility. The supply flow passage 420 may be partly formed to have a distribution flow passage for distributing the ink to a plurality of spots or may be partly formed integrally with the liquid discharging head 310 or the pressure regulating valve 320.

The controller 600 is a robot controller for controlling driving of the robot 200. Although not illustrated in FIG. 1, a control module that controls discharging operation in the liquid discharging unit 300 is electrically connected to the controller 600. A computer is communicably connected to the controller 600 and the control module. The control module corresponds to a control module 500 described below and illustrated in FIG. 2. The computer corresponds to a computer 700 described below and illustrated in FIG. 2.

1-2. Electrical Configuration of Three-Dimensional Object Printing Apparatus

Figure 2:
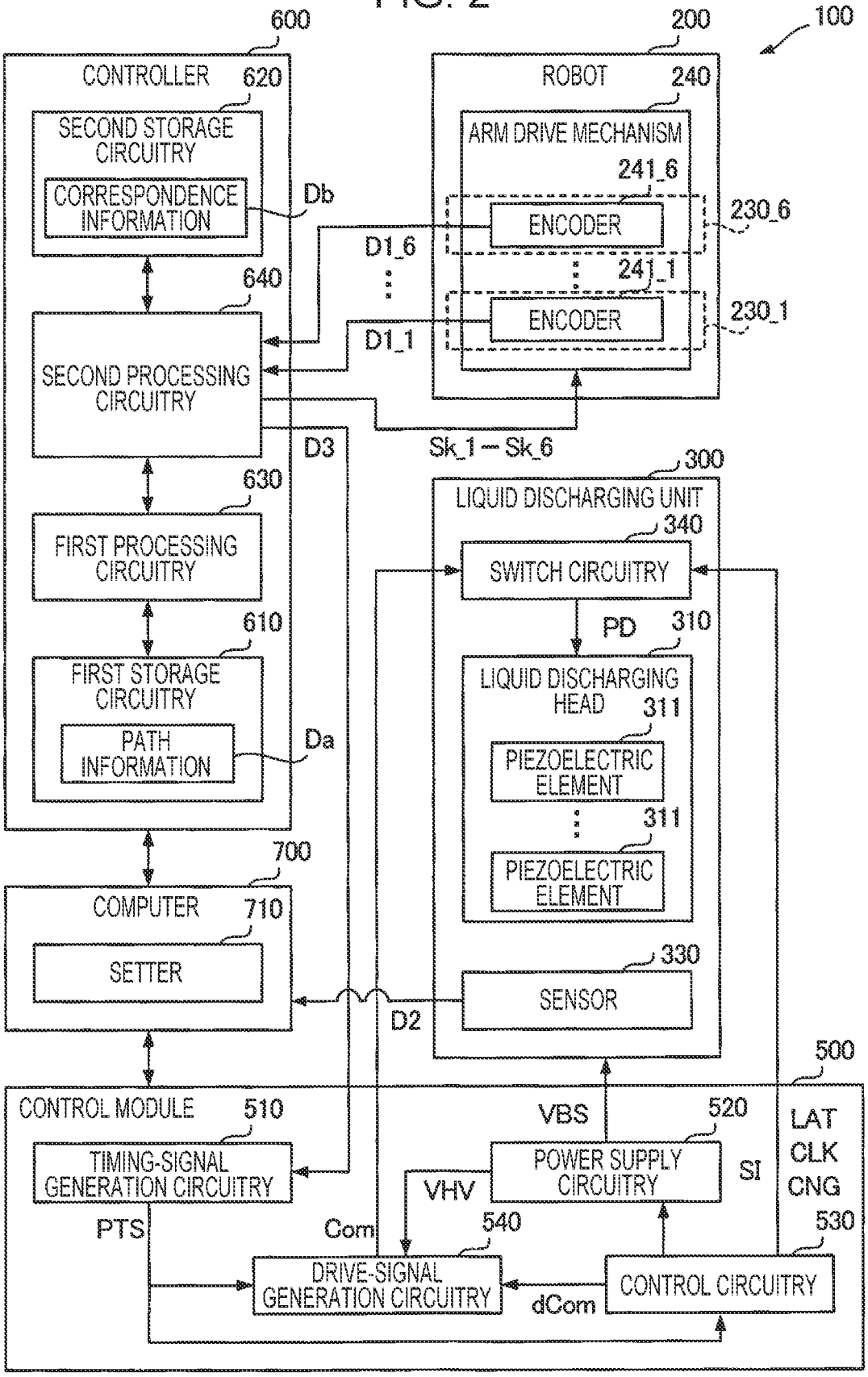
FIG. 2 is a block diagram illustrating an electrical configuration of the three-dimensional object printing apparatus according to the first embodiment.

FIG. 2 is a block diagram illustrating an electrical configuration of the three-dimensional object printing apparatus 100 according to the first embodiment. FIG. 2 illustrates electrical constituent elements of the constituent elements in the three-dimensional object printing apparatus 100. FIG. 2 also illustrates the arm drive mechanism 240 including encoders 241_1 to 241_6. The arm drive mechanism 240 is the above-described assembly of the drive mechanisms for operating the joint portions 230_1 to 230_6. The encoders 241_1 to 241_6 are rotary encoders provided corresponding to the joint portions 230_1 to 230_6 to measure the amounts of operations, such as the rotation angles of the joint portions 230_1 to 230_6. Hereinafter, each of the encoders 241_1 to 241_6 may be referred to as an "encoder 241".

As illustrated in FIG. 2, the three-dimensional object printing apparatus 100 includes the control module 500 and the computer 700 in addition to the robot 200, the liquid discharging unit 300, and the controller 600, which are described above. The control module 500, the controller 600, and the computer 700 are components for controlling the three-dimensional object printing apparatus 100 and function as a control unit of the three-dimensional object printing apparatus 100. Each electrical constituent element described below may be divided as appropriate, may be partly included in another constitute element, or may be partly configured integrally with another constituent element. For example, some or all of the functions of the control module 500 or the controller 600 may be implemented by the computer 700 connected to the controller 600 or may be implemented by another external device, such as personal computer (PC) connected to the controller 600 through a network, such as a local area network (LAN) or the Internet.

The controller 600 has a function for controlling driving of the robot 200 and a function for generating a signal D3 for synchronizing the discharging operation of the liquid discharging head 310 with an operation of the robot 200. The controller 600 includes first storage circuitry 610, second storage circuitry 620, first processing circuitry 630, and second processing circuitry 640.

The first storage circuitry 610 stores therein various programs executed by the first processing circuitry 630 and various types of data processed by the first processing circuitry 630. The first storage circuitry 610 includes, for example, one semiconductor memory that is one of a volatile memory and a nonvolatile memory or semiconductor memories constituted by both thereof. The volatile memory is, for example, a random-access memory (RAM), and the nonvolatile memory is, for example, a read-only memory (ROM), an electrically erasable programmable read-only memory (EEPROM), or a programmable ROM (PROM). The first storage circuitry 610 may be partly or entirely included the first processing circuitry 630.

Path information Da is stored in the first storage circuitry 610. The path information Da indicates a path along which the liquid discharging head 310 is to move. For example, the path information Da is represented by coordinate values of a base coordinate system. The path information Da is determined based on workpiece information indicating the position and the shape of the workpiece W. The workpiece information is obtained by associating information, such as computer-aided design (CAD) data indicating a three-dimensional shape of the workpiece W, with the base coordinate system. The above-described path information Da is input to the first storage circuitry 610 from the computer 700.

The second storage circuitry 620 stores therein various programs executed by the second processing circuitry 640 and various types of data processed by the second processing circuitry 640. The second storage circuitry 620 includes, for example, one semiconductor memory that is one of a volatile memory and a nonvolatile memory or semiconductor memories constituted by both thereof. The volatile memory is, for example, a RAM, and the nonvolatile memory is, for example, a ROM, an EEPROM, or a PROM. The second storage circuitry 620 may be partly or entirely included in the second processing circuitry 640 or may be partly or entirely configured integrally with the first storage circuitry 610.

Correspondence information Db is stored in the second storage circuitry 620. The correspondence information Db is information regarding a correspondence relationship between an output from one encoder 241 of the encoders 241_1 to 241_6 and a time or a position. The correspondence information Db is input to the second storage circuitry 620 from the computer 700. The correspondence information Db is described later in detail.

The first processing circuitry 630 computes the respective amounts of operations of the joint portions 230_1 to 230_6, based on the path information Da. Specifically, the first processing circuitry 630 performs inverse kinematics calculation, which is computation for converting the path information Da into amounts of operations, such as rotation angles and rotational speeds, of the respective joint portions 230_1 to 230_6.

The first processing circuitry 630 described above includes, for example, one or more processors, such as central processing units (CPUs). The first processing circuitry 630 may include a programmable logic device, such as a field-programmable gate array (FPGA), in place of or in addition to the CPU(s).

Based on a computational result of the first processing circuitry 630, the second processing circuitry 640 controls the operations of the joint portions 230_1 to 230_6 and generates the signal D3. Specifically, based on outputs D1_1 to D1_6 from the encoders 241_1 to 241_6 included in the arm drive mechanism 240 in the robot 200, the second processing circuitry 640 performs feedback control for outputting control signals Sk_1 to Sk_6 to the respective joint portions 230_1 to 230_6 so that the amounts of operations, such as the actual rotation angles and rotational speeds of the respective joint portions 230_1 to 230_6 match the computational result of the first processing circuitry 630. The control signals Sk_1 to Sk_6 correspond to the joint portions 230_1 to 230_6 and are used to control driving of motors provided for the corresponding joint portions 230. That is, the controller 600 controls the operation of the robot 200, based on the outputs D1_1 to D1_6 from the encoders 241_1 to 241_6 included in the arm drive mechanism 240. The outputs D1_1 to D1_6 correspond to the encoders 241_1 to 241_6. Each of the outputs D1_1 to D1_6 may hereinafter be referred to as an "output D1".

The second processing circuitry 640 generates the signal D3, based on the output D1 from one encoder 241 of the encoders 241_1 to 241_6. The correspondence information Db is used for generating the signal D3. The second processing circuitry 640 and the signal D3 are described later in detail.

The second processing circuitry 640 is implemented by circuitry independent from the first processing circuitry 630. This prevents processing load in the first processing circuitry 630 from affecting processing load in the second processing circuitry 640. For example, although the second processing circuitry 640 may include one or more processors, such as central processing units (CPUs), as in the first processing circuitry 630, it is preferable that the second processing circuitry 640 be circuitry having a shorter control cycle than the first processing circuitry 630. Reducing the control cycle of the second processing circuitry 640 can reduce the cycle of the feedback control on the joint portions 230_1 to 230_6 and can enhance the operation accuracy of the robot 200. In addition, compared with a case in which the control cycle of the second processing circuitry 640 is long, a time taken from when the output D1 from the encoder 241 is input to the second processing circuitry 640 until the signal D3 is output can be reduced, thus making it possible to suppress signal delay. From the perspective of facilitating generation of the signal D3 that suits the operating environment of the three-dimensional object printing apparatus 100, it is also preferable that the second processing circuitry 640 include a device that can execute computation. Examples of the device include an FPGA and a digital signal processor (DSP).

The control module 500 is circuitry for controlling the discharging operation of the liquid discharging head 310, based on the signal D3 output from the controller 600 and print data output from the computer 700. The control module 500 includes timing-signal generation circuitry 510, power supply circuitry 520, control circuitry 530, and drive-signal generation circuitry 540.

The timing-signal generation circuitry 510 generates a timing signal PTS in response to the signal D3. That is, the signal D3 is a trigger signal for starting generation of the timing signal PTS. The timing-signal generation circuitry 510 in the present embodiment includes a timer for starting generation of the timing signal PTS upon detecting a pulse PS included in the signal D3. The waveform of the signal D3 is described later in detail. Although details are described later, the timing signal PTS is a signal for specifying a timing of the operation of the liquid discharging head 310 and is the so-called pulse timing signal.

The power supply circuitry 520 receives electric power supplied from a commercial power supply, not illustrated, to generate predetermined various potentials. The generated various potentials are supplied to the individual portions in the three-dimensional object printing apparatus 100. For example, the power supply circuitry 520 generates a power-supply potential VHV and an offset potential VBS. The offset potential VBS is supplied to the liquid discharging unit 300. The power-supply potential VHV is supplied to the drive-signal generation circuitry 540.

Based on the timing signal PTS, the control circuitry 530 generates a control signal SI, a waveform designation signal dCom, a latch signal LAT, a clock signal CLK, and a change signal CNG. These signals synchronize with the timing signal PTS. Of the signals, the waveform designation signal dCom is input to the drive-signal generation circuitry 540, and the other signals SI, dCom, LAT, CLK, and CNG are input to switch circuitry 340 in the liquid discharging unit 300.

The control signal SI is a digital signal for designating operation states of the piezoelectric elements 311 included in the liquid discharging head 310. Specifically, the control signal SI designates whether or not a drive signal Com described below is to be supplied to the piezoelectric elements 311. For example, this designation designates whether or not the ink is to be discharged from the nozzles corresponding to the piezoelectric elements 311 and designates the amounts of ink to be discharge from the nozzles. The waveform designation signal dCom is a digital signal for designating the waveform of the drive signal Com. The latch signal LAT and the change signal CNG are used together with the control signal SI to specify the drive timing of the piezoelectric elements 311 and the discharge timing of the ink from the nozzles. The clock signal CLK is a reference clock signal that synchronizes with the timing signal PTS. Of the above-described signals, the signals SI, dCom, LAT, CLK, and CNG that are input to the switch circuitry 340 in the liquid discharging unit 300 are described later in detail.

The drive-signal generation circuitry 540 is circuitry that generates the drive signal Com for driving each piezoelectric element 311 included in the liquid discharging head 310. Specifically, the drive-signal generation circuitry 540 includes, for example, digital-to-analog (DA) conversion circuitry and amplification circuitry. In the drive-signal generation circuitry 540, the DA conversion circuitry converts the waveform designation signal dCom, output from the control circuitry 530, from a digital signal into an analog signal, and by using the power-supply potential VHV from the power supply circuitry 520, the amplification circuitry amplifies the analog signal to thereby generate the drive signal Com. In this case, a signal having a waveform that is included in waveforms included in the drive signal Com and that is actually supplied to the piezoelectric element 311 is a drive pulse PD. The drive pulse PD is supplied from the drive-signal generation circuitry 540 to the piezoelectric element 311 via the switch circuitry 340. Based on the control signal SI, the switch circuitry 340 switches whether or not at least one of the waveforms included in the drive signal Com is to be supplied as the drive pulse PD.

The computer 700 has a function for supplying the path information Da to the controller 600 and a function for supplying print data to the control module 500. In addition to these functions, the computer 700 in the present embodiment has a function for setting details of processing in the second processing circuitry 640. In the present embodiment, the details of processing include the contents of the correspondence information Db and a threshold for a starting timing of the signal D3.

The computer 700 in the present embodiment is also electrically connected to the aforementioned sensor 330, and can detect a relative position of the liquid discharging head 310 with respect to the workpiece W, based on a signal D2 from the sensor 330.

1-3. Liquid Discharging Unit

Figure 3:
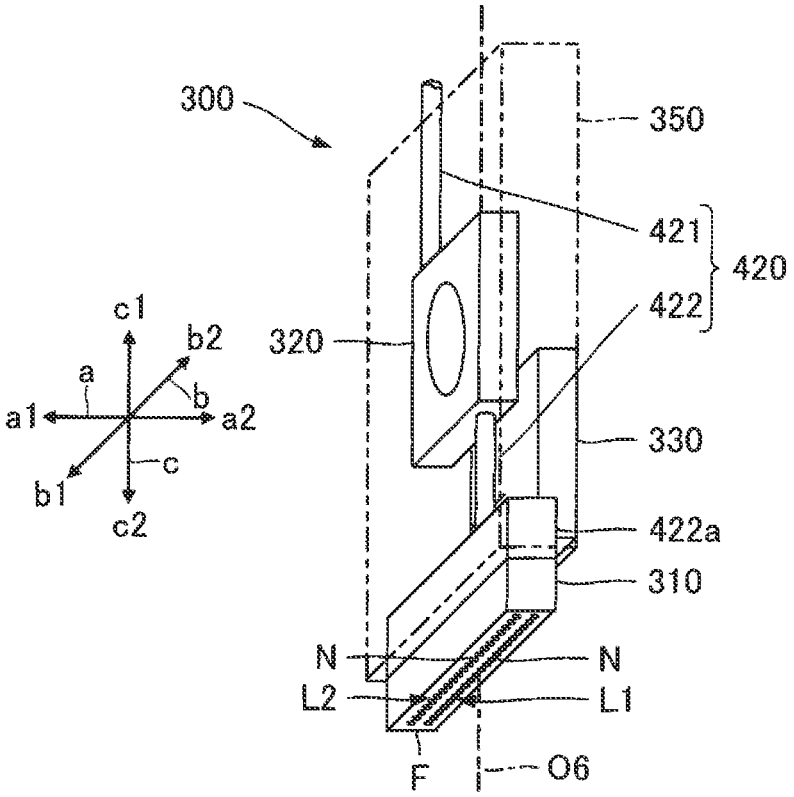
FIG. 3 is a perspective view illustrating a general configuration of a liquid discharging unit in the first embodiment.

FIG. 3 is a perspective view illustrating a general configuration of the liquid discharging unit 300 in the first embodiment.

The following description will be given using axes a, b, and c that cross each other. One direction along the axis a is referred to as "direction a1", and a direction that is opposite to the direction a1 is referred to as "direction a2". Similarly, directions that are opposite to each other along the axis b are referred to as "direction b1" and "direction b2". Also, directions that are opposite to each other along the axis c are referred to as "direction c1" and "direction c2".

Herein, the axes a, b, and c are coordinate axes of a tool coordinate system set for the liquid discharging unit 300, and the above-described relationships of the relative positions and orientations with respect to the X-axis, the Y-axis, and the Z-axis change depending on the operation of the robot 200. In the example illustrated in FIG. 3, the axis c is parallel to the above-described sixth rotation axis O6. Although the axes a, b, and c typically cross one another orthogonally, the present disclosure is not limited thereto. For example, the axes a, b, and c may cross one another at an angle in the range of 80° or and 100° or less.

As described above, the liquid discharging unit 300 includes the liquid discharging head 310, the pressure regulating valve 320, and the sensor 330, which are supported by a support 350 denoted by long dashed double-short dashed lines in FIG. 3.

The support 350 is made of, for example, a metallic material and is a substantial rigid body. Although the support 350 in FIG. 3 has a generally flat box shape, the shape of the support 350 is not particularly limiting and is arbitrary.

The support 350 is attached to the leading end, that is, the arm 226, of the arm 220. Thus, the liquid discharging head 310, the pressure regulating valve 320, and the sensor 330 are each secured to the arm 226.

In the example illustrated in FIG. 3, the pressure regulating valve 320 is located in the direction c1 with respect to the liquid discharging head 310. The sensor 330 is located in the direction a2 with respect to the liquid discharging head 310.

The supply flow passage 420 is divided into an upstream flow passage 421 and a downstream flow passage 422 by the pressure regulating valve 320. That is, the supply flow passage 420 has the upstream flow passage 421, which provides communication between the liquid reservoir 410 and the pressure regulating valve 320, and the downstream flow passage 422, which provides communication between the pressure regulating valve 320 and the liquid discharging head 310. In the example illustrated in FIG. 3, a part of the downstream flow passage 422 of the supply flow passage 420 is provided with a flow passage member 422*a*. The flow passage member 422*a* has a flow passage that distributes ink from the pressure regulating valve 320 to a plurality of portions in the liquid discharging head 310. The flow passage member 422*a* is, for example, a laminate of substrates made of resin material, and each substrate is provided with grooves or holes for ink flow passages, as appropriate.

The liquid discharging head 310 has a nozzle surface F and a plurality of nozzles N provided in the nozzle surface F. In the example illustrated in FIG. 3, the normal direction of the nozzle surface F is the direction c2, and the plurality of nozzles N is sectioned into a first nozzle array L1 and a second nozzle array L2, which are arranged with a gap therebetween in the direction along the axis a. Each of the first nozzle array L1 and the second nozzle array L2 is one example of a "nozzle array" and is a collection of nozzles N that are linearly arrayed in the direction along the axis b. Elements associated with the nozzles N in the first nozzle array L1 in the liquid discharging head 310 and elements associated with the nozzles N in the second nozzle array L2 are generally symmetric to each other in the direction along the axis a.

The nozzles N in the first nozzle array L1 and the nozzles N in the second nozzle array L2 may match each other or differ from each other in their positions in the direction along the axis b. Also, the elements associated with the nozzles N in one of the first nozzle array L1 and the second nozzle array L2 may be omitted. A configuration in which the positions of the nozzles N in the first nozzle array L1 and the positions of the nozzles N in the second nozzle array L2 in the direction along the axis b match each other will be described below by way of example.

1-4. Second Processing Circuitry 640

Figure 4:
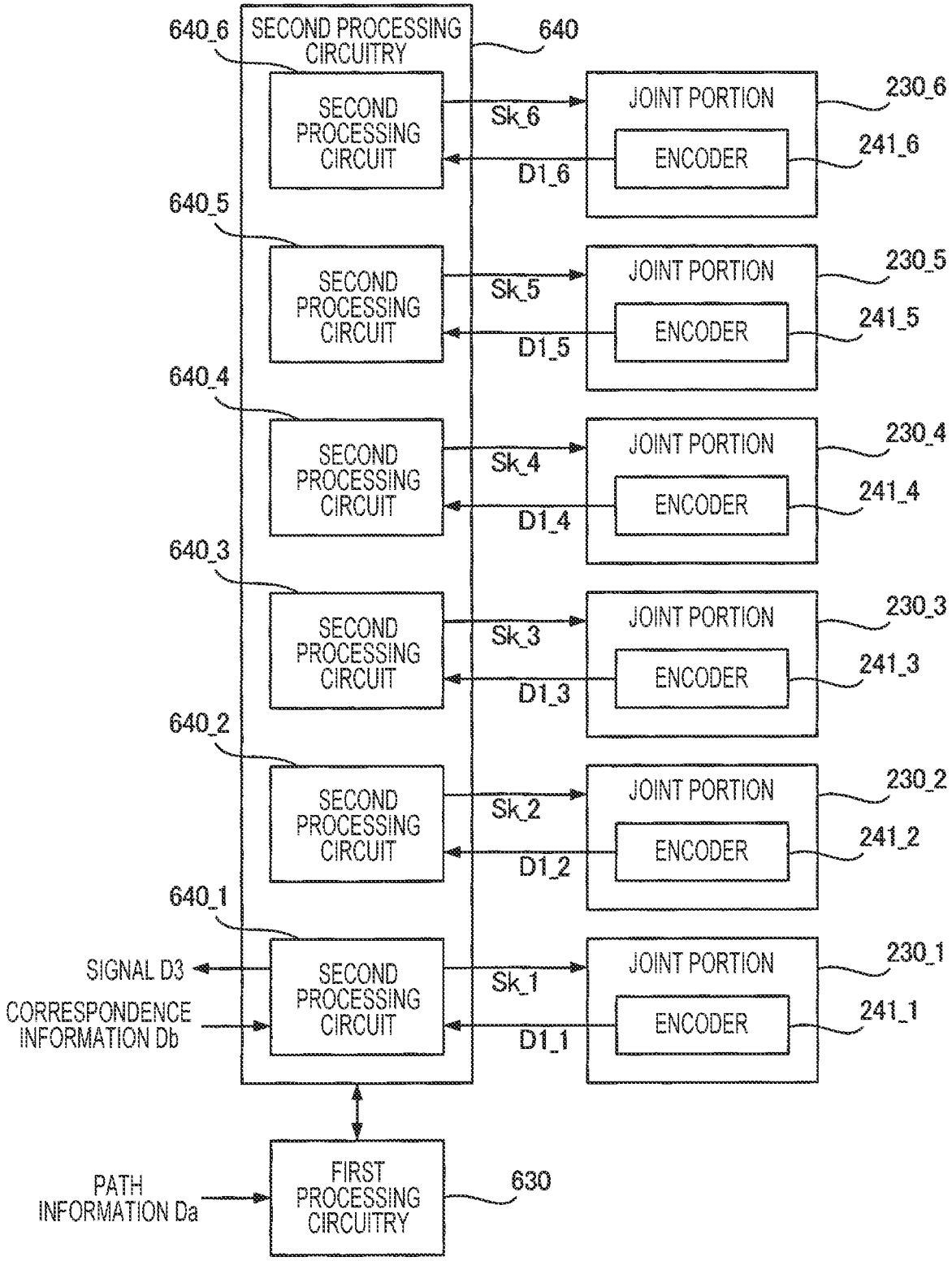
FIG. 4 is a diagram illustrating a specific configuration example of second processing circuitry.

FIG. 4 is a diagram illustrating a specific configuration example of the second processing circuitry 640. As illustrated in FIG. 4, the second processing circuitry 640 includes, for example, second processing circuits 640_1 to 640_6 provided corresponding to the joint portions 230_1 to 230_6.

Based on the output D1_1 from the encoder 241_1, the second processing circuit 640_1 outputs a control signal Sk_1 to control the amount of operation of the joint portion 230_1 so that the amount of operation, such as the actual rotation angle, of the joint portion 230_1 matches the computational result of the first processing circuitry 630. Similarly, based on the outputs D1_2 to D1_6 from the encoders 241_2 to 241_6, the second processing circuits 640_2 to 640_6 output control signals Sk_2 to Sk_6 to control the amounts of operations of the joint portions 230_2 to 230_6 so that the amounts of operations, such as the actual rotation angles of the joint portions 230_2 to 230_6 match the computational result of the first processing circuitry 630.

Of the second processing circuits 640_1 to 640_6, the second processing circuit 640_1 outputs the signal D3 by using the correspondence information Db, after the computer 700 sets the details of processing. In this case, by using the correspondence information Db, the second processing circuit 640_1 converts the output D1_1 from the encoder 241_1 into the signal D3.

Figure 5:
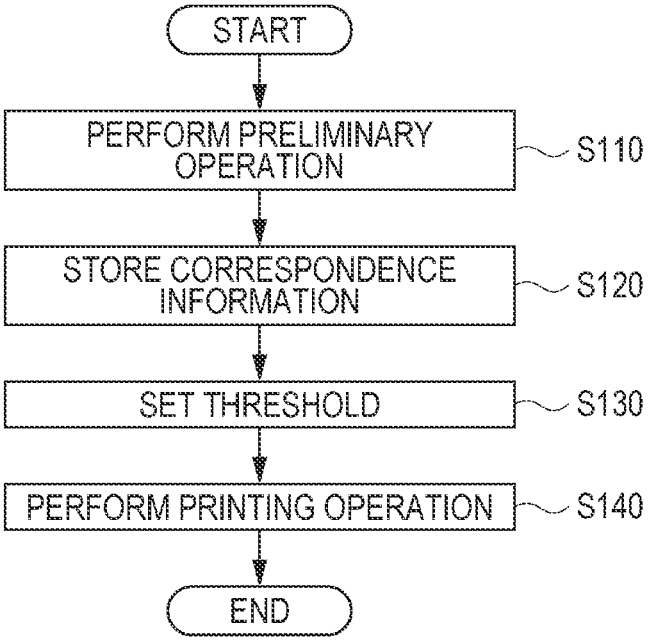
FIG. 5 is a flowchart illustrating a flow of a three-dimensional object printing method according to the first embodiment.

1-5. Operation of Three-dimensional Object Printing Apparatus and Three-dimensional Object Printing Method FIG. 5 is a flowchart illustrating a flow of a three-dimensional object printing method according to the first embodiment. The three-dimensional object printing method is performed using the three-dimensional object printing apparatus 100. First, as illustrated in FIG. 5, in step S110, the three-dimensional object printing apparatus 100 performs a preliminary operation. In this preliminary operation, while moving the liquid discharging head 310 through a path indicated by the path information Da, the robot 200 obtains output information regarding an output from the encoder 241_1 and position information regarding the relative position of the liquid discharging head 310 with respect to the workpiece W. This obtaining is performed by a setter 710 in the computer 700. The computer 700 executes a program, not illustrated, to thereby realize the setter 710. The position information may be obtained using a measurement result of the sensor 330 during the preliminary operation or may be obtained by computation performed in the first processing circuitry 630 through use of outputs from the encoders 241_1 to 241_6 during the preliminary operation. The position information may also be obtained by printing a test pattern on the workpiece W during the preliminary operation and imaging the test pattern with a camera, which is not illustrated. In such a case, for example, the camera is secured to the arm 226 to thereby fix mutual relationship of the positions and orientations of the liquid discharging unit 300 and the camera, and the position information is obtained based on image information acquired by the camera. Alternatively, the printing of the test pattern does not necessarily have to use the workpiece W and may also use an object whose print area of the test pattern has the same shape as the workpiece W.

In step S120, the three-dimensional object printing apparatus 100 stores the correspondence information Db. Specifically, after generating the correspondence information Db by using the position information and the output information obtained in step S110 described above, the three-dimensional object printing apparatus 100 stores the correspondence information Db in the second storage circuitry 620.

Next, in step S130, the three-dimensional object printing apparatus 100 sets a threshold t regarding the timing of the signal D3. Specifically, based on the position information and the output information obtained in step S110 described above, the threshold t is set so that the timing of the signal D3 during printing is a desired timing. This setting is performed by the setter 710 in the computer 700.

Next, in step S140, the three-dimensional object printing apparatus 100 performs a printing operation. In this printing operation, while the robot 200 moves the liquid discharging head 310 through a path indicated by the path information Da, the liquid discharging head 310 performs discharging operation. The discharging operation is performed in synchronization with the signal D3, based on print data from the computer 700. Thus, the discharging operation is controlled based on the output from the encoder 241_1 and the correspondence information Db.

Figure 6:
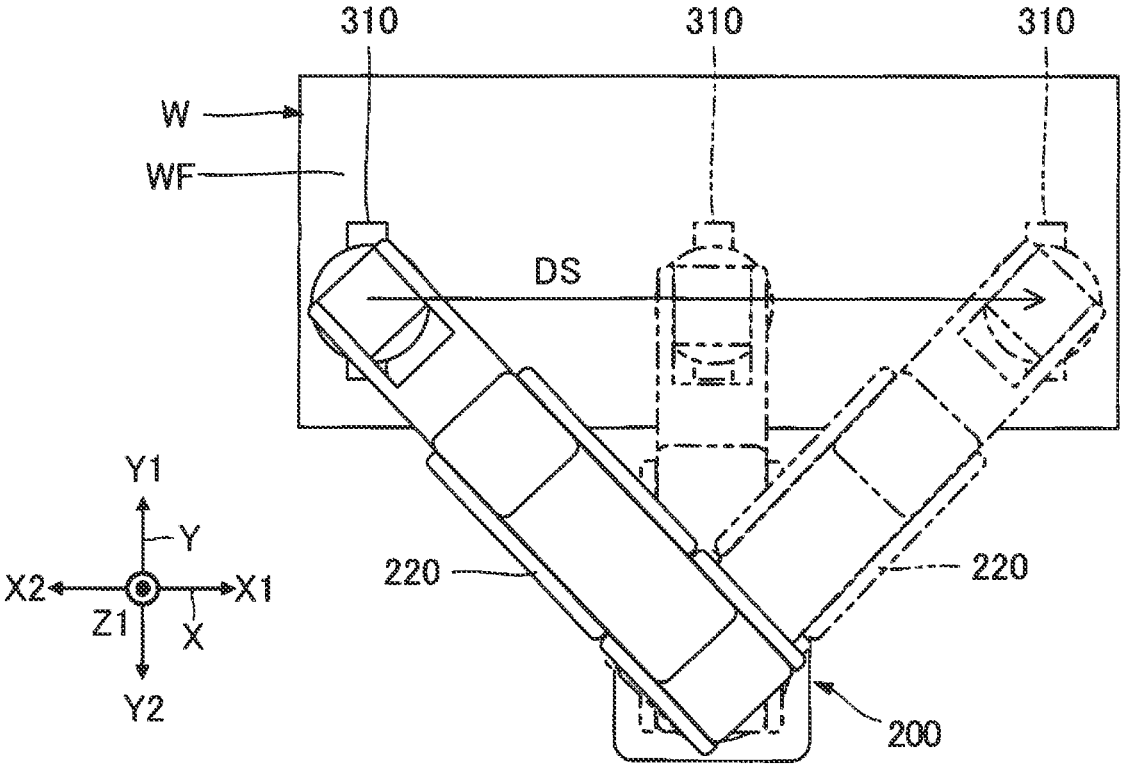
FIG. 6 is a diagram illustrating a printing operation in the first embodiment.

FIG. 6 is a diagram illustrating the printing operation in the first embodiment. FIG. 6 illustrates a state in which the three-dimensional object printing apparatus 100 performs printing on the surface WF of the workpiece W. As illustrated in FIG. 6, while the robot 200 moves the liquid discharging head 310 in a predetermined scan direction DS, the three-dimensional object printing apparatus 100 causes ink to be discharged from the liquid discharging head 310 to thereby perform printing on the surface WF. The scan direction DS is a direction along the path indicated by the above-described path information Da. In the example illustrated in FIG. 6, the scan direction DS is the X1 direction. Also, the direction a1 in the tool coordinate system matches the scan direction DS.

In this printing operation, the amounts of operations of the joint portions 230_1 to 230_6 need to be appropriately combined in order for the robot 200 to move the liquid discharging head 310 in the scan direction DS. Accordingly, the output D1 from each encoder 241 does not necessarily have a linear relationship with the position of the liquid discharging head 310 in the scan direction DS. The output D1 from each encoder 241 is a signal indicating rotation of the corresponding joint portion.

Figure 7:
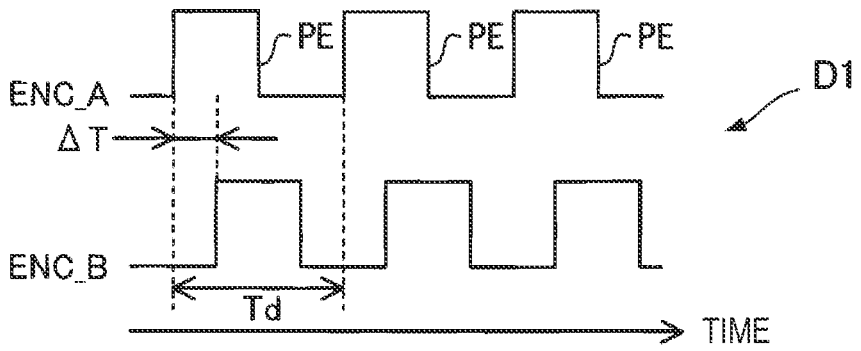
FIG. 7 is a graph illustrating one example of signals output from each encoder.

FIG. 7 is a graph illustrating one example of signals output from each encoder 241. Although not illustrated, the encoder 241 includes, for example, a scale, a light-emitting element, and a light-receiving element. The light-emitting element emits light to the scale. Upon receiving light that is reflected by or passes through the scale as a result of the light emission, the light-receiving element outputs signals ENC_A and ENC_B as signals output from the encoder 241, as illustrated in FIG. 7. The encoder 241 may be an absolute encoder or may be an incremental encoder. Also, the waveforms of the signals are not limited to the example illustrated in FIG. 7.

Each of the signals ENC_A and ENC_B includes a pulse PE that appears upon rotation of the corresponding joint portion. A time interval Td at which the pulse PE appears decreases as the rotational speed of the joint portion increases. Thus, the rotational speed of the joint portion can be measured based on the time interval Td. The time interval Td of the signal ENC_A and the time interval Td of the signal ENC_B are equal to each other. The phase of the signal ENC_A and the phase of the signal ENC_B are shifted from each other by 90 degrees, which is the amount of shift, $\Delta T$. In this case, a direction in which the phase of the signal ENC_A and the phase of the signal ENC_B are shifted from each other differs depending on the rotation direction of the joint portion. Thus, based on that direction, it is possible to identify the rotation direction of the joint portion.

Figure 8:
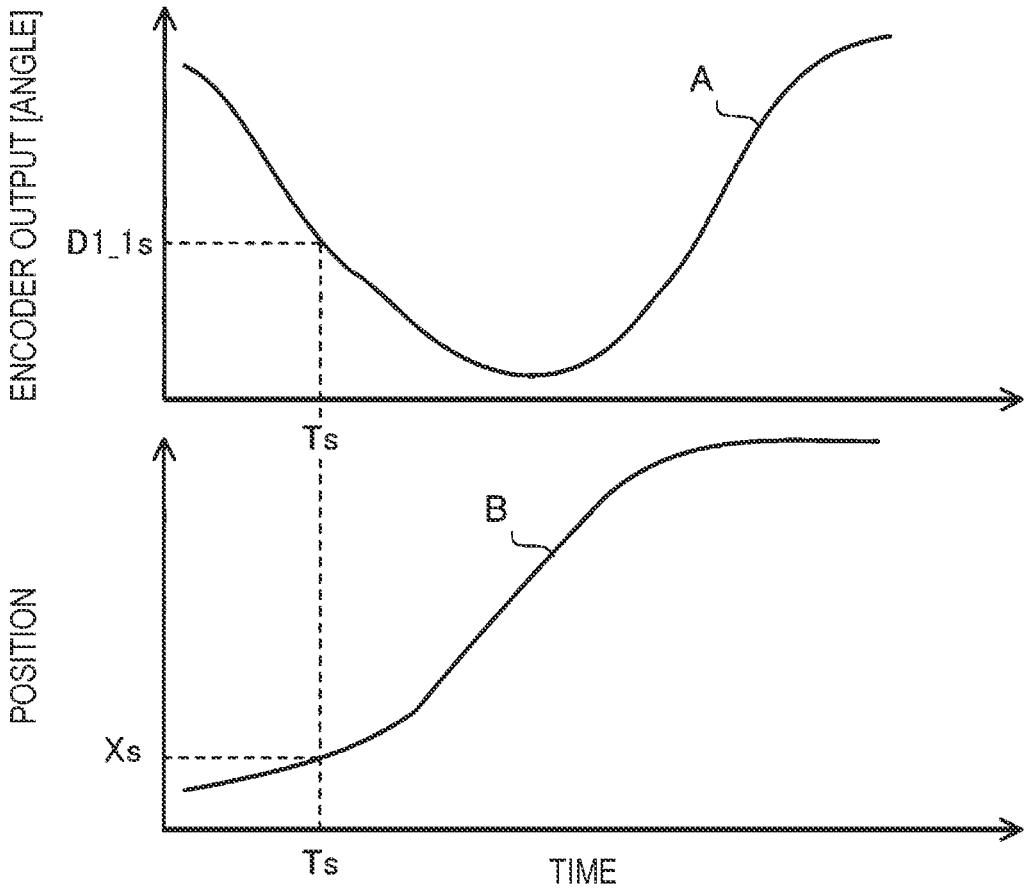
FIG. 8 is a graph illustrating one example of correspondence information.

FIG. 8 is a graph illustrating the correspondence information Db. The upper part in FIG. 8 illustrates transition A of the output D1_1 from the encoder 241_1 when the robot 200 moves the liquid discharging head 310 through the path indicated by the path information Da during printing operation. The lower part in FIG. 8 illustrates transition B of a position where the liquid discharging head 310 can perform printing in the X-axis direction on the surface WF of the workpiece W.

The position of the liquid discharging unit 300 that is to perform first printing while the liquid discharging unit 300 passes above the surface WF of the workpiece W along the scan direction DS is referred to as a "print starting position Xs". Also, a time taken from when the robot 200 starts driving until it reaches an appropriate position at which the liquid discharging unit 300 starts discharge of liquid in order to perform printing on the print starting position Xs is referred to as a "discharge starting time Ts". That is, in order to ensure that printing on the surface WF of the workpiece W is appropriately performed from the print starting position Xs, ink discharging from the liquid discharging unit 300 needs to be started at the timing of the discharge starting time Ts.

In the present embodiment, based on the above-described preliminary operation, a correspondence relationship between the discharge starting time Ts at which printing can be appropriately performed on the print starting position Xs and an output D1_1 of the encoder 241_1 at the discharge starting time Ts is pre-recognized as the correspondence information Db. Thus, based on the output D1_1 from the encoder 241_1, ink can be discharged from the liquid discharging unit 300 at the timing of the appropriate discharge starting time Ts, and printing can be appropriately performed from the print starting position Xs. Although, in the example illustrated in FIG. 8, the description has been given using only positions in the X-axis direction since the scan direction DS of the liquid discharging head 310 is the X-axis direction, positions in the Y-axis direction or the Z-axis direction can also be used depending on the scan direction.

In the present embodiment, based on the above-described preliminary operation, correspondence relationships with the output D1_1 of the encoder 241_1 at the print starting position Xs can also be recognized as the correspondence information Db. Thus, based on the output D1_1 from the encoder 241_1, ink can be discharged from the liquid discharging unit 300 at the timing of the appropriate discharge starting time Ts, and printing can be appropriately performed from the print starting position Xs.

Figure 9:
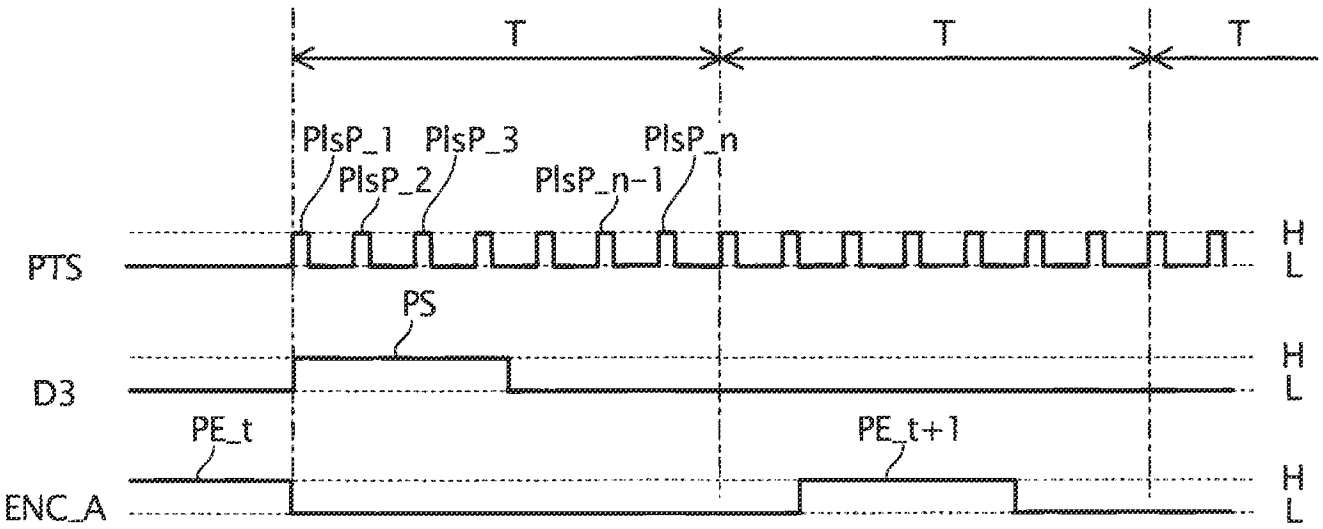
FIG. 9 is a timing chart illustrating an operation of timing-signal generation circuitry in the first embodiment.

FIG. 9 is a timing chart illustrating an operation of the timing-signal generation circuitry 510 in the first embodiment. The signal D3 includes the pulse PS. The pulse PS appears upon appearance of a pulse PE_t of the signal ENC_A output from the encoder 241. The pulse PE_t is a pulse PE that appears at a timing set according to a predetermined threshold t. In this case, a pulse PE_t+1 illustrated in FIG. 9 is a pulse PE that follows the pulse PE_t. The pulse PS may be caused to appear upon appearance of another pulse of the signal ENC_B or the like output from the encoder 241.

As illustrated in FIG. 9, upon appearance of the pulse PS, the timing signal PTS is output from the timer included in the timing-signal generation circuitry 510. The timing signal PTS is input to the control circuitry 530 and the drive-signal generation circuitry 540. Upon input of the timing signal PTS, the control circuitry 530 and the drive-signal generation circuitry 540 output, to the switch circuitry 340, signals for controlling discharge of liquid. That is, the pulse included in the signal D3 is a trigger signal for the liquid discharging head 310 to start discharge of the liquid. FIG. 9 illustrates a case in which outputting of the timing signal PTS is started at a rising timing of the pulse PS. In this case, since the rising timing of the pulse PS matches a falling timing of the pulse PE_t of the signal ENC_A, the outputting of the timing signal PTS is started at the falling timing of the pulse PE_t in the example illustrated in FIG. 9. The outputting of the timing signal PTS may also be started at the falling timing of the pulse PS.

The timing signal PTS includes n pulses PlsP in each period T, where n is a natural number greater than or equal to 1. A case in which n is 7 is illustrated in FIG. 9 as an example. In FIG. 9, the n pulses PlsP are denoted as pulses PlsP_1 to PlsP_n. In this case, n is not limited to the example illustrated in FIG. 9, and for instance, n is, preferably, in the range of 1 or more and 20 or less and is, more preferably, in the range of 5 or more and 10 or less.

The period T corresponds to, for example, a unit period Tu described below. The timing of the pulses PlsP may be shifted from the timing of a pulse PlsL (described below) of the latch signal LAT. The length of the period T may be the same as or different from the length of the unit period Tu. When the length of the period T is the same as the length of the unit period Tu, the control circuitry 530 may directly output the timing signal PTS as the latch signal LAT or may output the timing signal PTS as the latch signal LAT at a shifted timing. When the length of the period T is different from the length of the unit period Tu, the control circuitry 530 performs processing for converting the timing signal PTS into the latch signal LAT.

Figure 10:
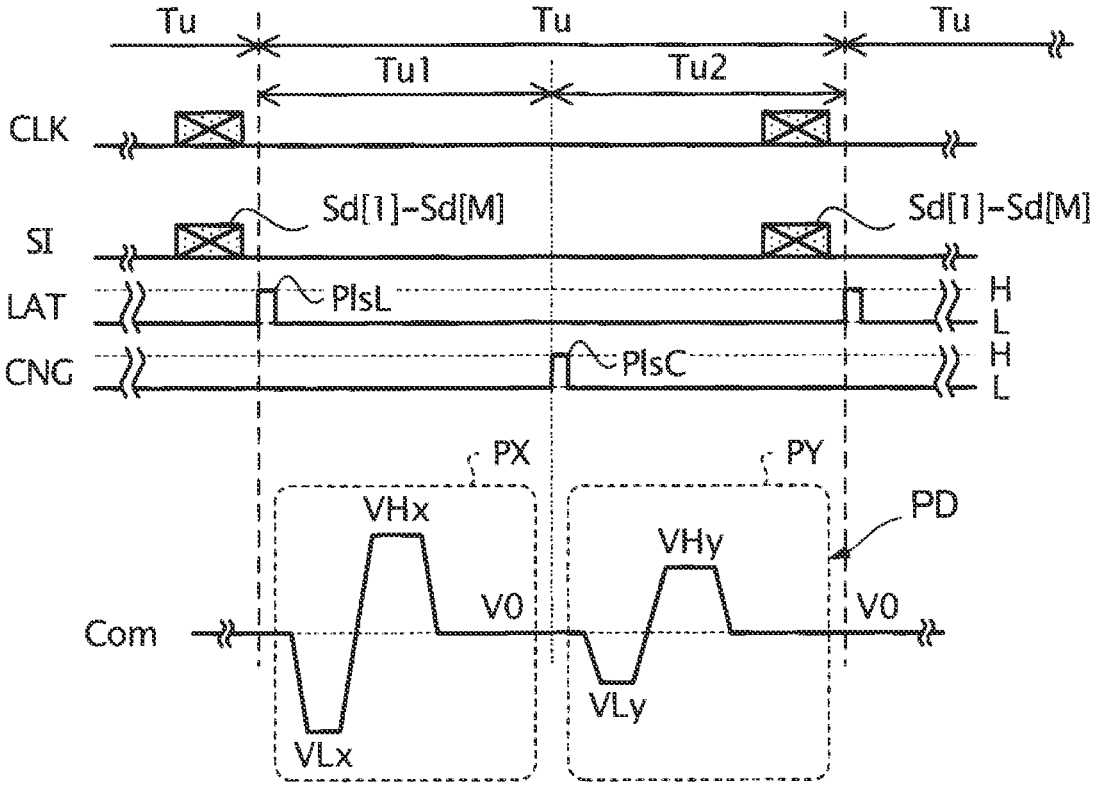
FIG. 10 is a timing chart illustrating an operation of switch circuitry.

FIG. 10 is a timing chart illustrating an operation of the switch circuitry 340. As illustrated in FIG. 10, the latch signal LAT includes the pulse PlsL for specifying the unit period Tu. The unit period Tu is specified, for example, as a period from when one pulse PlsL rises until a next pulse PlsL rises. Also, the change signal CNG includes a pulse PlsC for sectioning the unit period Tu into a control period Tu1 and a control period Tu2. The control period Tu1 is, for example, a period from rising of the pulse PlsL to rising of the pulse PlsC. The control period Tu2 is, for example, a period from the rising of the pulse PlsC to the rising of the pulse PlsL.

Also, the control signal SI includes individual designation signals Sd[1] to Sd[M] that designate types of operations of the piezoelectric elements 311[1] to 311[M] in each unit period Tu. Prior to each unit period Tu, the individual designation signals Sd[1] to Sd[M] are supplied to the switch circuitry 340 in synchronization with the clock signal CLK. In the unit period Tu, the switch circuitry 340 switches between an on state and an off state, based on the individual designation signal Sd[m]. M is the number of piezoelectric elements 311, and m is a natural number that is greater than or equal to 1 and is less than or equal to M. The suffix [M] or [m] is a notation for distinguishing M piezoelectric elements 311. Also, the suffix [m] is hereinafter used for other M elements to indicate correspondence relationships with the piezoelectric elements 311[*m*].

As illustrated in FIG. 10, the drive signal Com has a waveform PX in the control period Tu1 and a waveform PY in the control period Tu2. In the example illustrated in FIG. 10, the potential difference between a highest potential VHx and a lowest potential VLx in the waveform PX is larger than the potential difference between a highest potential VHy and a lowest potential VLy in the waveform PY. The waveform of the drive signal Com is not limited to the example illustrated in FIG. 10, and, for example, the waveform PY may be omitted.

When the individual designation signal Sd[m] has a value designating formation of a middle dot, the switch circuitry 340 is turned on in the control period Tu1 and is turned off in the control period Tu2. Thus, only the waveform PX in the drive signal Com is supplied to the corresponding piezoelectric element 311 as the drive pulse PD. As a result, an amount of ink corresponding to the middle dot is discharged from the nozzle corresponding to the piezoelectric element 311.

When the individual designation signal Sd[m] has a value designating formation of a small dot, the switch circuitry 340 is turned off in the control period Tu1 and is turned on in the control period Tu2. Thus, only the waveform PY in the drive signal Com is supplied to the piezoelectric element 311 as the drive pulse PD. As a result, an amount of ink corresponding to the small dot is discharged from the nozzle corresponding to the piezoelectric element 311.

When the individual designation signal Sd[m] has a value designating formation of a large dot, the switch circuitry 340 is turned on in both the control periods Tu1 and Tu2. Thus, the waveforms PX and PY in the drive signal Com are supplied to the piezoelectric element 311 as the drive pulse PD. As a result, an amount of ink corresponding to the large dot is discharged from the nozzle corresponding to the piezoelectric element 311.

When the individual designation signal Sd[m] has a value designating that ink is not to be discharged, the switch circuitry 340 is turned off in both the control periods Tu1 and Tu2. Thus, neither the waveform PX nor the waveform PY in the drive signal Com is supplied to the piezoelectric element 311. As a result, no ink is discharged from the nozzle corresponding to the piezoelectric element 311.

As described above, the three-dimensional object printing apparatus 100 includes the liquid discharging head 310, the robot 200, and the N encoders 241, where N is a natural number greater than or equal to 2. Herein, the liquid discharging head 310 discharges ink, which is one example of "liquid", to the three-dimensional workpiece W. The robot 200 has the N joint portions 230, which are examples of "N movable portions", to change the relative position of the liquid discharging head 310 with respect to the workpiece W. The N encoders 241 are provided for the N joint portions 230 to measure the amounts of operations of the N joint portions 230, respectively.

In the present embodiment, one encoder 241_1 of the N encoders 241 is exemplified as a "first encoder". The three-dimensional object printing apparatus 100 stores the correspondence information Db, and while operating the robot 200, the three-dimensional object printing apparatus 100 controls the discharging operation of the liquid discharging head 310, based on an output from the encoder 241_1 and the correspondence information Db. The correspondence information Db is information regarding the correspondence relationship between the output from the encoder 241_1 and a time during operation of the robot 200. The correspondence information Db may include the relative position of the liquid discharging head 310 with respect to the workpiece W, instead of the time.

In the present embodiment, the three-dimensional object printing apparatus 100 has N encoders that measure the amounts of operations of the N movable portions, and can control the operation of the robot 200, based on outputs from at least two encoders of the N encoders. That is, by performing computation using outputs from at least two encoders, the controller 600 obtains the position information of the liquid discharging unit 300. Also, based on the obtained position information, the controller 600 performs feedback control for sending control signals designating the amounts of operations to the at least two movable portions. As a result, the controller 600 can appropriately control the operation of the robot 200. The three-dimensional object printing apparatus 100 can also control the operation of the robot 200, based on outputs from all the N encoders. Similarly, the operation of the robot 200 can be controlled based on the outputs from the encoders corresponding to the joints that operate during operation of the robot 200.

In the three-dimensional object printing apparatus 100 described above, the discharging operation of the liquid discharging head 310 can be synchronized with the operation of the robot 200 at a desired timing by using an output from the encoder 241_1 and the correspondence information Db, without using all outputs from the N encoders 241. Compared with a configuration in which all outputs from the N encoders 241 are used to determine the desired timing, the amount of processing load for the determination is small, thus making it possible to reduce the amount of signal delay due to the determination. As a result, it is possible to reduce displacement of a print position or shift of a print timing. Thus, an image quality of printing on the three-dimensional workpiece W can be enhanced using the robot 200.

Thus, the three-dimensional object printing apparatus 100 controls the discharging operation of the liquid discharging head 310 without using the position information obtained by computation using all outputs from the N encoders 241, to thereby make it possible to reduce displacement of a print position or shift of a print timing.

In this case, the discharging operation of the liquid discharging head 310 is controlled without using at least one encoder 241 except the encoder 241_1 of the N encoders 241. That is, when one encoder 241 different from the encoder 241_1 of the N encoders 241 is referred to as a "second encoder", the discharging operation of the liquid discharging head 310 is controlled without using an output from the second encoder.

Also, the discharging operation of the liquid discharging head 310 is controlled without using outputs from the N−1 encoders 241 other than the encoder 241_1 of the N encoders 241. Thus, the amount of processing load for determining the relative position of the liquid discharging head 310 can be reduced, compared with a configuration in which two or more encoders 241 are used for the discharge control of the liquid discharging head 310. The number of encoders 241 used for the discharge control of the liquid discharging head 310 is not limited to one and may be any number that is less than N−1.

It is preferable that the encoder 241 used to control the discharging operation of the liquid discharging head 310 be provided for the joint portion 230 whose amount of operation is the largest among the N joint portions 230 during the operation of the robot 200. In the present embodiment, the encoder 241_1 is provided for the joint portion 230_1 whose amount of operation is the largest among the N joint portions 230 during the operation of the robot 200. Thus, the discharging operation of the liquid discharging head 310 can be controlled using an output from one encoder 241_1 in a wide range during the operation of the robot 200. Although, in the present embodiment, the signal D3 is generated using an output from the encoder 241_1, the signal D3 may be generated using an output from another encoder 241 instead of or in addition to the output from the encoder 241_1.

As described above, the three-dimensional object printing apparatus 100 in the present embodiment includes the control module 500, the first processing circuitry 630, and the second processing circuitry 640, in addition to the liquid discharging head 310, the robot 200, and the encoders 241_1 to 241_6. The control module 500 controls the discharging operation of the liquid discharging head 310. The first processing circuitry 630 computes the amounts of operations of the respective joint portions 230_1 to 230_6, based on the path information Da indicating a path along which the liquid discharging head 310 is to move. The encoder 241_1 connects to the first processing circuitry 630 via the second processing circuitry 640, and the control module 500 connects to the second processing circuitry 640. Also, the control module 500 connects to the first processing circuitry 630 via the second processing circuitry 640. Based on the output from the encoder 241_1, the second processing circuitry 640 generates the signal D3 for synchronizing the discharging operation of the liquid discharging head 310 with the operation of the robot 200. The second processing circuitry 640 is electrically connected to the control module 500. On the other hand, the first processing circuitry 630 is electrically connected to the control module 500 via the second processing circuitry 640.

As described above, the control module 500 connects to the second processing circuitry 640 provided between the first processing circuitry 630 and the encoder 241_1, and the second processing circuitry 640 generates the signal D3. Thus, compared with a configuration in which the first processing circuitry 630 generates the signal D3, it is possible to reduce the amount of processing load on the second processing circuitry 640. Also, compared with a configuration in which the first processing circuitry 630 generates the signal D3, it is possible to reduce a signal propagation path from the encoder 241_1 to the control module 500. As a result, it is possible to reduce displacement of a print position or shift of a print timing.

In addition, since the second processing circuitry 640 is circuitry different from the first processing circuitry 630, control cycles of these circuits 640 and 630 can be made different from each other. It is preferable that the control cycle of the second processing circuitry 640 be shorter than the control cycle of the first processing circuitry 630. In this case, the second processing circuitry 640 can quickly make a determination for generating the signal D3, compared with a case in which the control cycle of the second processing circuitry 640 is longer than or equal to the control cycle of the first processing circuitry 630.

In the present embodiment, the signal D3 is generated using only the output from one encoder 241_1 of the N encoders 241. That is, the second processing circuitry 640 generates the signal D3 to be input to the control module 500, without using the outputs from the N−1 encoders 241 other than the encoder 241_1 of the N encoders 241. Accordingly, when one encoder different from the encoder 241_1 of the N encoders 241 is referred to as a "second encoder", the second processing circuitry 640 generates the signal D3 to be input to the control module 500, without using the output from the second encoder.

At a timing at which the number of pulses PE output from the encoder 241_1 in a period during driving of the robot 200 exceeds the threshold t, the second processing circuitry 640 varies the signal D3 to be input to the control module 500. Thus, in response to the variation in the signal D3, the control module 500 can synchronize the discharging operation of the liquid discharging head 310 with the operation of the robot 200.

In the present embodiment, the second processing circuitry 640 is a device, such as an FPGA or a DSP, that can execute computation. The three-dimensional object printing apparatus 100 further includes the setter 710 that sets details of processing in the second processing circuitry 640. While operating the robot 200, the setter 710 obtains output information regarding an output from the encoder 241_1 and position information regarding the relative position of the liquid discharging head 310 with respect to the workpiece W, and sets details of processing in the second processing circuitry 640, based on the output information and the position information.

In this case, the setter 710 sets the above-described threshold t as details of processing in the second processing circuitry 640. Thus, it is possible to set the threshold t that suits the operating condition of the robot 200.

The position information is obtained by, for example, computation in the first processing circuitry 630 which uses outputs from the N encoders 241. Thus, the amount of processing load on the second processing circuitry 640 is reduced, compared with a configuration in which the position information is obtained by the second processing circuitry 640.

Also, when the three-dimensional object printing apparatus 100 includes the sensor 330 that measures the relative position of the liquid discharging head 310 with respect to the workpiece W, as in the present embodiment, the position information may be obtained using a measurement result of the sensor 330. In such a case, high-accuracy position information can be obtained compared with a configuration in which the position information is obtained by computation using outputs from the N encoders 241.

Also, the signal D3 to be input to the control module 500 from the second processing circuitry 640 includes a trigger signal for starting driving of the liquid discharging head 310. This preferably prevents displacement of a print starting position, thus making it possible to preferably prevent displacement of a print position.

2. Second Embodiment

A second embodiment of the present disclosure will be described below. In the second embodiment exemplified below, elements having effects and functions that are analogous to those in the first embodiment are denoted by the reference numerals that are used in the first embodiment, and detailed descriptions thereof are not given hereinafter.

Figure 11:
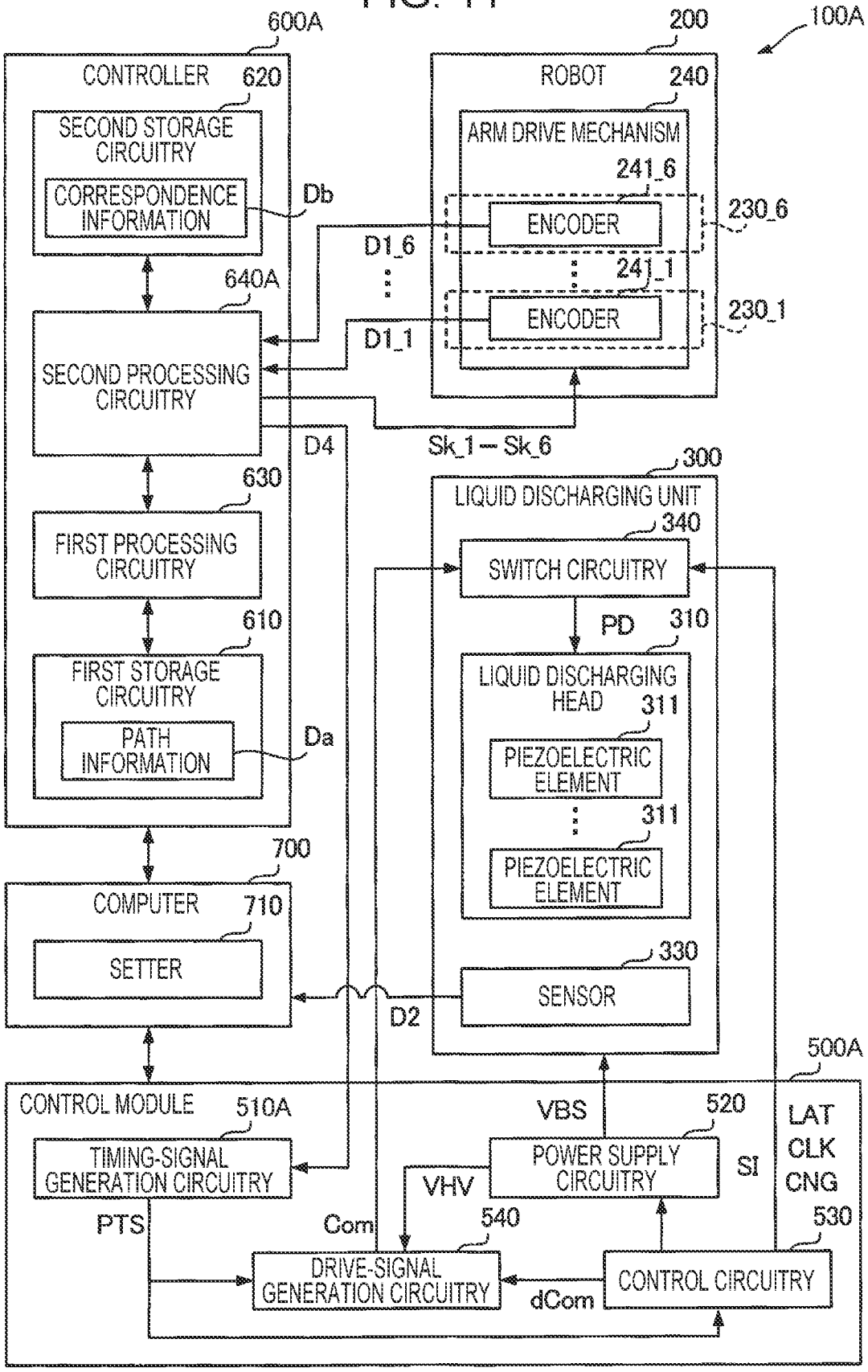
FIG. 11 is a block diagram illustrating an electrical configuration of a three-dimensional object printing apparatus according to a second embodiment.

FIG. 11 is a block diagram illustrating an electrical configuration of a three-dimensional object printing apparatus 100A according to the second embodiment. The three-dimensional object printing apparatus 100A is substantially the same as the above-described three-dimensional object printing apparatus 100 in the first embodiment, except that the three-dimensional object printing apparatus 100A includes a controller 600A and a control module 500A in place of the controller 600 and the control module 500.

The controller 600A is substantially the same as the above-described controller 600, except that the controller 600A includes second processing circuitry 640A in place of the second processing circuitry 640. The second processing circuitry 640A is substantially the same as the above-described second processing circuitry 640, except that the second processing circuitry 640A generates a signal D4 instead of the signal D3.

The signal D4 includes a pulse PE that appears for each unit change of the relative position of the liquid discharging head 310 with respect to the workpiece W in the scan direction DS. The signal D4 is generated based on the output D1_1 from the encoder 241_1 which corresponds to the amount of operation of the joint portion 230_1 during printing operation and the correspondence information Db. The correspondence information Db in the present embodiment indicates transition (illustrated at the upper part in FIG. 8) of the output D1_1 from the encoder 241_1 during printing operation, that is, the relationship between an output from the encoder and a time. Alternatively, the correspondence information Db in the present embodiment indicates the relationship between the output D1_1 from the encoder 241_1 and the relative position of the liquid discharging head 310 with respect to the workpiece W. When the controller 600A pre-stores the correspondence information Db, the signal D4 corresponding to the moving time or the position of the liquid discharging head 310 can be generated based on the output from the encoder 241.

The control module 500A is substantially the same as the above-described control module 500, except that the control module 500A includes a timing-signal generation circuitry 510A in place of the timing-signal generation circuitry 510. Based on the signal D4, the timing-signal generation circuitry 510A generates the timing signal PTS. The timing-signal generation circuitry 510A in the present embodiment is implemented by multiplication circuitry that multiplies the signal D4 so that it is converted into the timing signal PTS.

Figure 12:
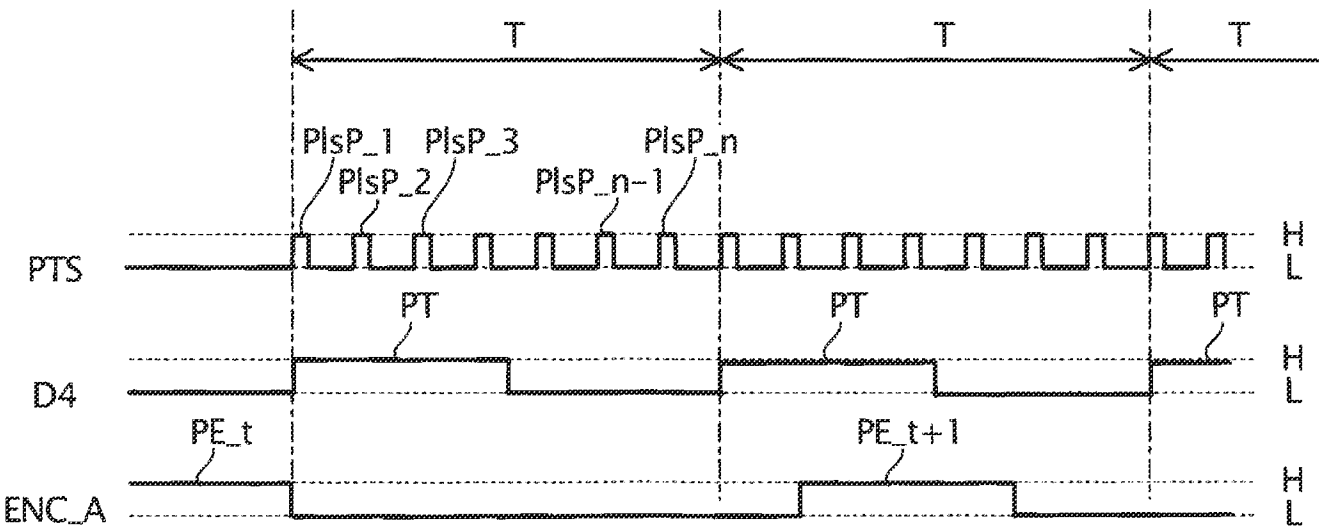
FIG. 12 is a timing chart illustrating an operation of timing-signal generation circuitry in the second embodiment.

FIG. 12 is a timing chart illustrating the operation of the timing-signal generation circuitry 510A in the second embodiment. The signal D4 includes a plurality of pulses PT. When the moving speed of the liquid discharging head 310 in the scan direction DS is constant, the time interval at which the pulse PT appears is constant. FIG. 12 illustrates a case in which this time interval is equal to the period T.

As illustrated in FIG. 12, outputting of the timing signal PTS is started upon appearance of the pulse PT. That is, as in the first embodiment, the pulse included in the signal D4 serves as a trigger signal for the liquid discharging head 310 to start discharge of liquid. FIG. 12 illustrates a case in which the outputting of the timing signal PTS is started at a rising timing of the pulse PT. The outputting of the timing signal PTS may be started at a falling timing of the pulse PT. As described above, the timing signal PTS in the first embodiment is output from the timer included in the timing-signal generation circuitry 510. In contrast, in the second embodiment, the timing-signal generation circuitry 510A converts the signal D4 into the timing signal PTS and outputs the timing signal PTS.

In the three-dimensional object printing apparatus 100A, an image quality of printing on the three-dimensional workpiece W can be enhanced using the robot 200, as in the three-dimensional object printing apparatus 100 in the first embodiment. In the second embodiment, the signal D4 input to the control module 500A from the second processing circuitry 640A includes a timing signal for specifying a drive timing of the liquid discharging head 310. This makes it possible to preferably prevent shift of the print timing.

3. Third Embodiment

A third embodiment of the present disclosure will be described below. In the third embodiment described below, elements having effects and functions that are analogous to those in the first embodiment are denoted by the reference numerals that are used in the first embodiment, and detailed descriptions thereof are not given hereinafter.

Figure 13:
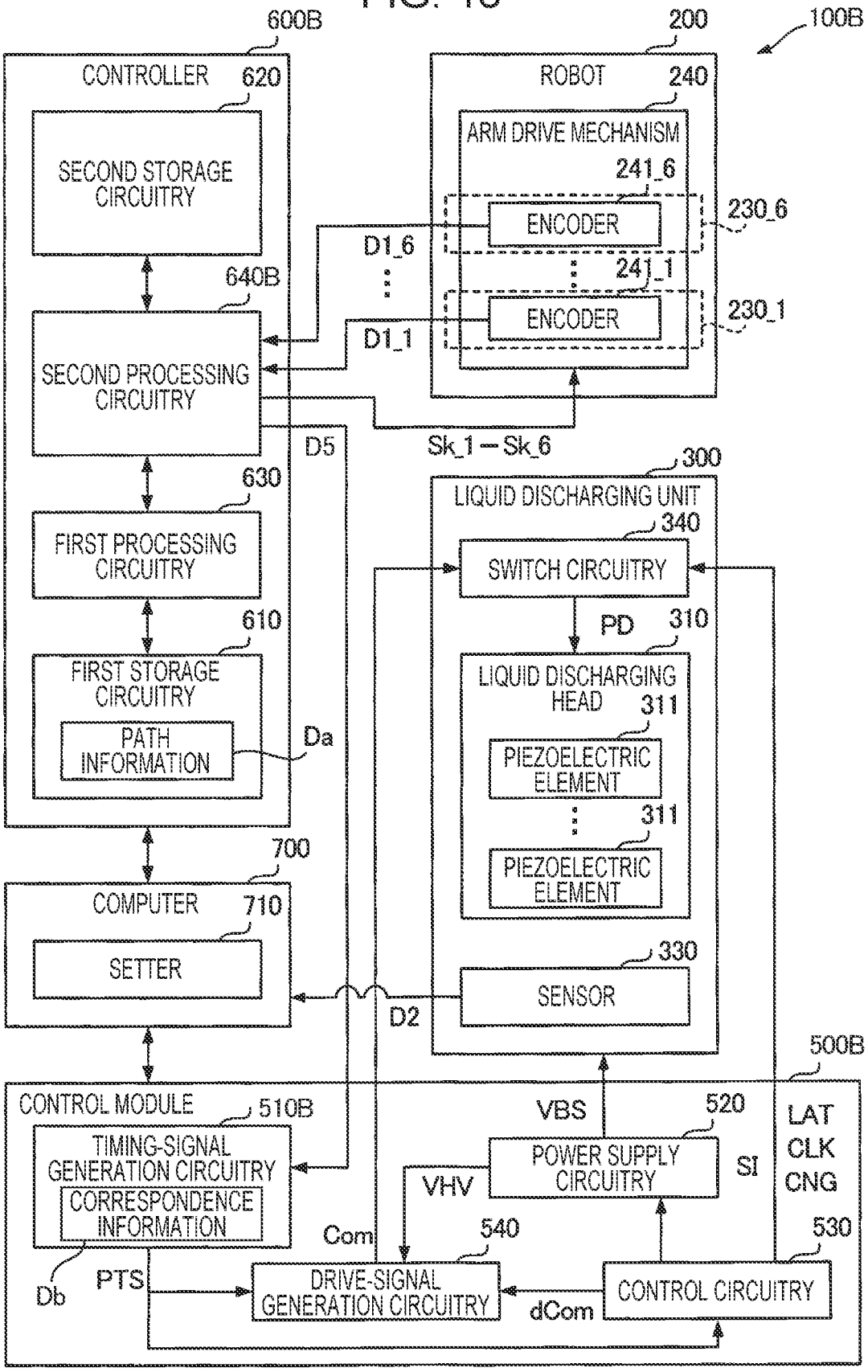
FIG. 13 is a block diagram illustrating an electrical configuration of a three-dimensional object printing apparatus according to a third embodiment.

FIG. 13 is a block diagram illustrating an electrical configuration of a three-dimensional object printing apparatus 100B according to the third embodiment. The three-dimensional object printing apparatus 100B is substantially the same as the above-described three-dimensional object printing apparatus 100 in the first embodiment, except that the three-dimensional object printing apparatus 100B includes a controller 600B and a control module 500B in place of the controller 600 and the control module 500.

The controller 600B is substantially the same as the above-described controller 600, except that the controller 600B includes second processing circuitry 640B in place of the second processing circuitry 640. The second processing circuitry 640B is substantially the same as the above-described second processing circuitry 640, except that the second processing circuitry 640B generates a signal D5 instead of the signal D3.

The signal D5 is a signal that is an output itself from the encoder 241_1 or a signal based on an output from the encoder 241_1.

The control module 500B is substantially the same as the above-described control module 500, except that the control module 500B includes a timing-signal generation circuitry 510B in place of the timing-signal generation circuitry 510. Based on the signal D5, the timing-signal generation circuitry 510B generates the timing signal PTS. The timing-signal generation circuitry 510B in the present embodiment uses the correspondence information Db to convert the signal D5 into the timing signal PTS. The correspondence information Db in the present embodiment indicates, for example, transition (illustrated at the upper part in FIG. 8) of the output D1_1 from the encoder 241_1 during printing operation, that is, the relationship between an output from the encoder and a time. Alternatively, the correspondence information Db in the present embodiment indicates the relationship between the output D1_1 from the encoder 241_1 and the relative position of the liquid discharging head 310 with respect to the workpiece W. When the control module 500A pre-stores the correspondence information Db, the signal D5 corresponding to the moving time or the position of the liquid discharging head 310 can be generated based on the output from the encoder 241.

Figure 14:
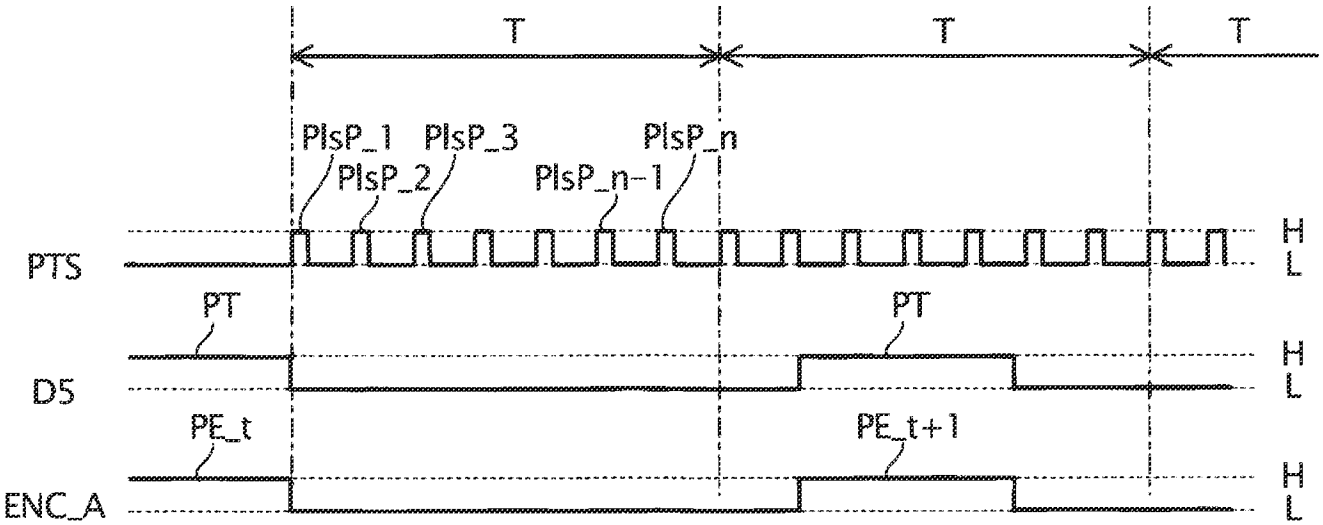
FIG. 14 is a timing chart illustrating an operation of timing-signal generation circuitry in the third embodiment.

FIG. 14 is a timing chart illustrating an operation of the timing-signal generation circuitry 510B in the third embodiment. The signal D5 includes a plurality of pulses PT. FIG. 14 illustrates a case in which the signal ENC_A from the encoder 241 is directly used as the signal D5. Accordingly, in the example illustrated in FIG. 14, the time interval at which the pulse PT appears is equal to the time interval at which the pulse PE of the signal ENC_A from the encoder 241 appears.

As illustrated in FIG. 14, outputting of the timing signal PTS is started upon appearance of the pulse PT. FIG. 14 illustrates a case in which the outputting of the timing signal PTS is started at the falling timing of the pulse PT. The outputting of the timing signal PTS may be started at the rising timing of the pulse PT.

In the third embodiment, an image quality of printing on the three-dimensional workpiece W can be enhanced using the robot 200, as in the first or second embodiment described above. In the third embodiment, since the control module 500B uses the correspondence information Db, the amount of processing load on the second processing circuitry 640B can be reduced compared with the second embodiment.

4. Modifications

Each embodiment exemplified above can be modified in various manners. Specific modifications that are applicable to each embodiment described above will be described below by way of example. Two or more modifications that are arbitrarily selected from the examples below can be appropriately combined together within a scope in which they do not contradict each other.

4-1. First Modification

Although a configuration in which a six-axis vertical multi-axis robot is used as a moving mechanism has been described in the above embodiments by way of example, the present disclosure is not limited thereto. The moving mechanism may be any mechanism that can three-dimensionally change the relative position and the orientation of the liquid discharging head with respect to a workpiece. Accordingly, the moving mechanism may be, for example, a vertical multi-axis robot having axes other than six axes or may be a horizontal multi-axis robot. Also, the movable portions of the robot arms are not limited to the rotation mechanisms and may have, for example, telescopic mechanisms.

4-2. Second Modification

Although a configuration in which screwing or the like is used as a method for securing the liquid discharging head to the leading end of the robot arm has been described in the above embodiments by way of example, the present disclosure is not limited thereto. For example, a gripping mechanism, such as a hand, attached to the leading end of the robot arm may grip the liquid discharging head to secure the liquid discharging head to the leading end of the robot arm.

4-3. Third Modification

In addition, although a moving mechanism configured to move the liquid discharging head has been described in the above embodiments by way of example, the present disclosure is not limited thereto. For example, the present disclosure can be applied to a configuration in which the position of the liquid discharging head is secured, and the moving mechanism moves a workpiece to three-dimensionally change the relative position and orientation of the workpiece with respect to the liquid discharging head. In this case, for example, a gripping mechanism, such as a hand, attached to the leading end of the robot arm grips the workpiece.

4-4. Fourth Modification

Although a configuration in which one type of ink is used to perform printing has been described in the above embodiments by way of example, the present disclosure is not limited thereto and can be applied to a configuration in which two or more types of ink are used to perform printing.

4-5. Fifth Modification

Applications of the three-dimensional object printing apparatus in the present disclosure are not limited to printing. For example, the three-dimensional object printing apparatus in the present disclosure can be used to discharge a solution of coloring material and is applicable to a manufacturing apparatus for forming color filters in liquid-crystal display devices. The three-dimensional object printing apparatus in the present disclosure can also be used to discharge a solution of electrically conductive material and is applicable to a manufacturing apparatus for forming wires and electrodes at wiring substrates. The three-dimensional object printing apparatus in the present disclosure can also be utilized as a jet dispenser for applying liquid, such as an adhesive, to a workpiece.

What is claimed is:

1. A three-dimensional object printing apparatus comprising:

a liquid discharging head that discharges liquid to a three-dimensional workpiece;

a robot that has N movable portions and that changes a relative position of the liquid discharging head with respect to the workpiece, where N is a natural number greater than or equal to 2; and N encoders provided for the N movable portions to measure amounts of operations of the N movable portions, respectively, wherein correspondence information, regarding a correspondence relationship between an output from a first encoder and a discharge start time during which liquid discharge occurs during the operation of the robot, is stored, the first encoder being one of the N encoders; and a discharging operation of the liquid discharging head is controlled based on an output from the first encoder and the correspondence information, while the robot is operated.

2. The three-dimensional object printing apparatus according to claim 1, wherein the discharging operation of the liquid discharging head is controlled without using position information obtained by computation using all outputs from the N encoders.

3. The three-dimensional object printing apparatus according to claim 1, wherein the discharging operation of the liquid discharging head is controlled without using an output from a second encoder that is one of the N encoders and that is different from the first encoder.

4. The three-dimensional object printing apparatus according to claim 3, wherein the operation of the robot is controlled based on outputs from the first encoder and the second encoder.

5. The three-dimensional object printing apparatus according to claim 1, wherein the discharging operation of the liquid discharging head is controlled without using outputs from N−1 encoders other than the first encoder of the N encoders.

6. The three-dimensional object printing apparatus according to claim 1, wherein the first encoder is provided for the movable portion that is included in the N movable portions and whose amount of operation is largest during the operation of the robot.

* * * * *